US010440985B2

(12) United States Patent
Eusepi et al.

(10) Patent No.: US 10,440,985 B2
(45) Date of Patent: Oct. 15, 2019

(54) TRAY FOR CONTAINING PRODUCTS WITH REDUCED LONGITUDINAL DIMENSIONS FOR THE TOBACCO INDUSTRY

(71) Applicant: G.D S.p.A., Bologna (IT)

(72) Inventors: Ivan Eusepi, Castel Maggiore (IT); Marco Esposti, Casalecchio di Reno (IT); Massimo Sartoni, Bologna (IT)

(73) Assignee: G.D. S.P.A., Bologna (IT)

( * ) Notice: Subject to any disclaimer, the term of this patent is extended or adjusted under 35 U.S.C. 154(b) by 606 days.

(21) Appl. No.: 14/891,999

(22) PCT Filed: May 20, 2014

(86) PCT No.: PCT/IB2014/061560
§ 371 (c)(1),
(2) Date: Nov. 18, 2015

(87) PCT Pub. No.: WO2014/188339
PCT Pub. Date: Nov. 27, 2014

(65) Prior Publication Data

US 2016/0088872 A1 Mar. 31, 2016

(30) Foreign Application Priority Data

May 24, 2013 (IT) ..... BO2013A0261

(51) Int. Cl.
*A24C 5/47* (2006.01)
*A24C 5/352* (2006.01)
*A24C 5/358* (2006.01)

(52) U.S. Cl.
CPC ..... *A24C 5/478* (2013.01); *A24C 5/352* (2013.01); *A24C 5/358* (2013.01)

(58) Field of Classification Search
None
See application file for complete search history.

(56) References Cited

U.S. PATENT DOCUMENTS 3,853,364 A 12/1974 Lundberg
4,338,057 A 7/1982 Molins
(Continued)

FOREIGN PATENT DOCUMENTS

CN 101631479 A 1/2010
DE 4404901 A1 8/1995
(Continued)

OTHER PUBLICATIONS

International Search Report and Written Opinion dated Oct. 15, 2014 for related PCT Application No. PCT/IB2014/0061560.
(Continued)

*Primary Examiner* — Dennis R Cordray
(74) *Attorney, Agent, or Firm* — Shuttleworth & Ingersoll, PLC; Timothy J. Klima

(57) ABSTRACT

A tray for containing products with reduced longitudinal dimensions, including a plurality of accumulation chambers, each of which is delimited by a rear wall, a base wall and two side walls for containing a layer of a plurality of the products stored according to an ordered orientation and covering an entire surface of the rear wall The accumulation chambers define modules whose respective rear walls are parallel to each other and a distance between two rear walls of two adjacent modules is substantially the same as reduced longitudinal dimensions of the products contained therein. Each tray includes a plurality of stackable modules which can be closed in a pack to define the thickness of the tray itself. A connecting and disconnecting mechanism is provided between each module and another so that the tray may be composed of a variable number of modules.

20 Claims, 6 Drawing Sheets

(56) References Cited

U.S. PATENT DOCUMENTS

| | | | | |
|---|---|---|---|---|
| 4,449,625 | A * | 5/1984 | Grieben | A24C 5/352 198/465.1 |
| 5,553,988 | A | 9/1996 | Horn et al. | |
| 5,597,219 | A | 1/1997 | Horun et al. | |
| 8,100,621 | B2 | 1/2012 | Budny et al. | |
| 9,573,707 | B2 | 2/2017 | Owezarek et al. | |
| 2008/0213072 | A1 | 9/2008 | Budny et al. | |
| 2008/0223803 | A1 | 9/2008 | Budny et al. | |
| 2014/0097107 | A1 | 4/2014 | Kagajska et al. | |

FOREIGN PATENT DOCUMENTS

| | | | |
|---|---|---|---|
| DE | 4404902 | A1 | 8/1995 |
| JP | S51174771 | | 12/1976 |
| JP | H07313133 | A | 12/1995 |
| JP | 2008195536 | A | 8/2008 |
| JP | 2008230703 | A | 10/2008 |
| JP | 2014512188 | A | 5/2014 |
| JP | 2014529401 | A | 11/2014 |
| WO | WO03039980 | A1 | 5/2003 |
| WO | WO2012144914 | A1 | 10/2012 |
| WO | WO2013025114 | A2 | 2/2013 |

OTHER PUBLICATIONS

Japanese Search Report dated Dec. 5, 2017 from counterpart JP App No. 2016-514511.

* cited by examiner

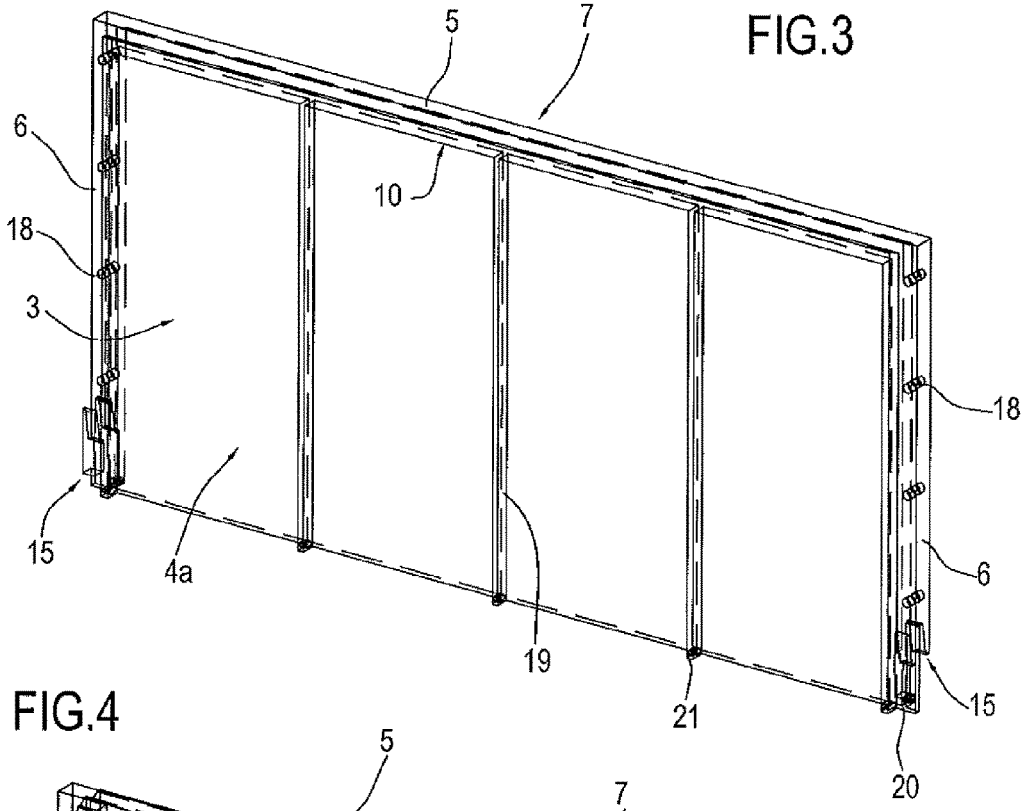
FIG.3
FIG.4
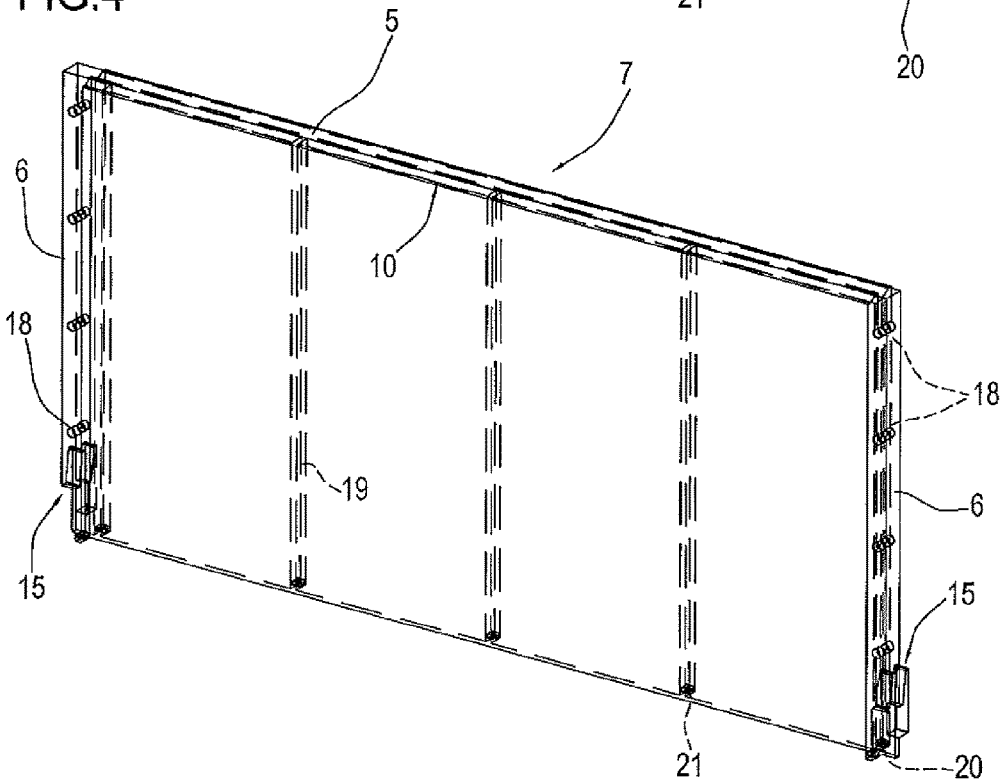

TRAY FOR CONTAINING PRODUCTS WITH REDUCED LONGITUDINAL DIMENSIONS FOR THE TOBACCO INDUSTRY

TECHNICAL FIELD

This invention relates to a tray for containing products with reduced longitudinal dimensions for the tobacco industry.

BACKGROUND ART

By way of example only, the term "products with reduced longitudinal dimensions" is used to mean pieces of filter material, such as cylinders of activated carbon, cellulose acetate, paper and the like and even pieces of tubes of plastic or plasticized material and including also small spherical products, such as beads which may, in particular, constitute flavouring additives for cigarette tobacco or for the filters themselves.

The above listed products, also referred to as "basic products", are fed to cigarette manufacturing or making machines and, more specifically, to machines for making composite filters, that is, filters obtained by juxtaposing two or more pieces of filter having different filtering properties and which, when finished, have longitudinal dimensions which are relatively much longer than the individual basic products themselves.

In state-of-the-art tobacco industry machines, which work at very high speeds, these basic products are obtained from elongate elements or rods which are cut during the process cycle in the machines themselves until reaching the reduced longitudinal dimensions the basic products are required to have.

In order to clarify the dimensions involved, it should be considered, purely as an example, without limiting the invention, that these basic products have transversal dimensions ranging from 5 to 8 mm and longitudinal dimensions from 6 to 9 mm, whilst the longitudinal dimensions of the elongate elements or rods are 6 to 15 times those of the basic products.

It is evident that the relatively large longitudinal dimensions of the rods allow easy, particularly precise and stable handling and also allows the rods to be fed at speeds which are not excessively high.

Since the basic products need to be supplied to the manufacturing machines after they have been cut to their final reduced longitudinal dimensions, which is why experts in the trade refer to them as "non-cuttable" products, they give rise to major problems of handling and stability during feeding to the manufacturing machines.

These problems are added to the need to attain feed speeds which are impossible for hitherto known devices for products having such reduced dimensions.

In the prior art, it is also the practice for the elongate elements or rods, which are cut during the process cycle directly in the machines themselves until reaching the reduced longitudinal dimensions of the basic products, to be fed to the manufacturing machines using containers, known as trays, in which the rods are stored in batches according to an ordered orientation and later emptied at the feed stations of the aforementioned manufacturing machines.

Trays known in the current state of the art basically comprise a rear wall, two substantially parallel side walls spaced from each other and a base wall, in such a way as to form an accumulation chamber for accumulating a batch of the rods and subsequently emptying the rods therefrom.

Prior art trays are not adaptable to the requirements of accumulating and emptying the products with reduced longitudinal dimensions ready cut to their reduced longitudinal dimensions and even less are they capable of keeping these products arranged according to their original, ordered and predetermined orientation, especially while they are being emptied.

DISCLOSURE OF THE INVENTION

This invention has for an aim to overcome the above mentioned problems by providing a tray capable of accumulating and containing the products with reduced longitudinal dimensions already cut to the required reduced dimensions, and of keeping the products with reduced longitudinal dimensions securely in place in the original position and orientation with which they are accumulated in the tray itself.

The technical purpose and aims specified are substantially achieved by a tray according to the present disclosure for containing products with reduced longitudinal dimensions for the tobacco industry.

BRIEF DESCRIPTION OF THE DRAWINGS

Further features and advantages of the invention are more apparent in the non-limiting description below, with reference to a preferred but non-exclusive embodiment of a tray for containing products with reduced longitudinal dimensions for the tobacco industry, as illustrated in the accompanying drawings, in which:

FIGS. 3 and 4 show, respectively, a chamber and/or a module making up the tray of FIG. 1;

DETAILED DESCRIPTION OF PREFERRED EMBODIMENTS OF THE INVENTION

Figure 1:
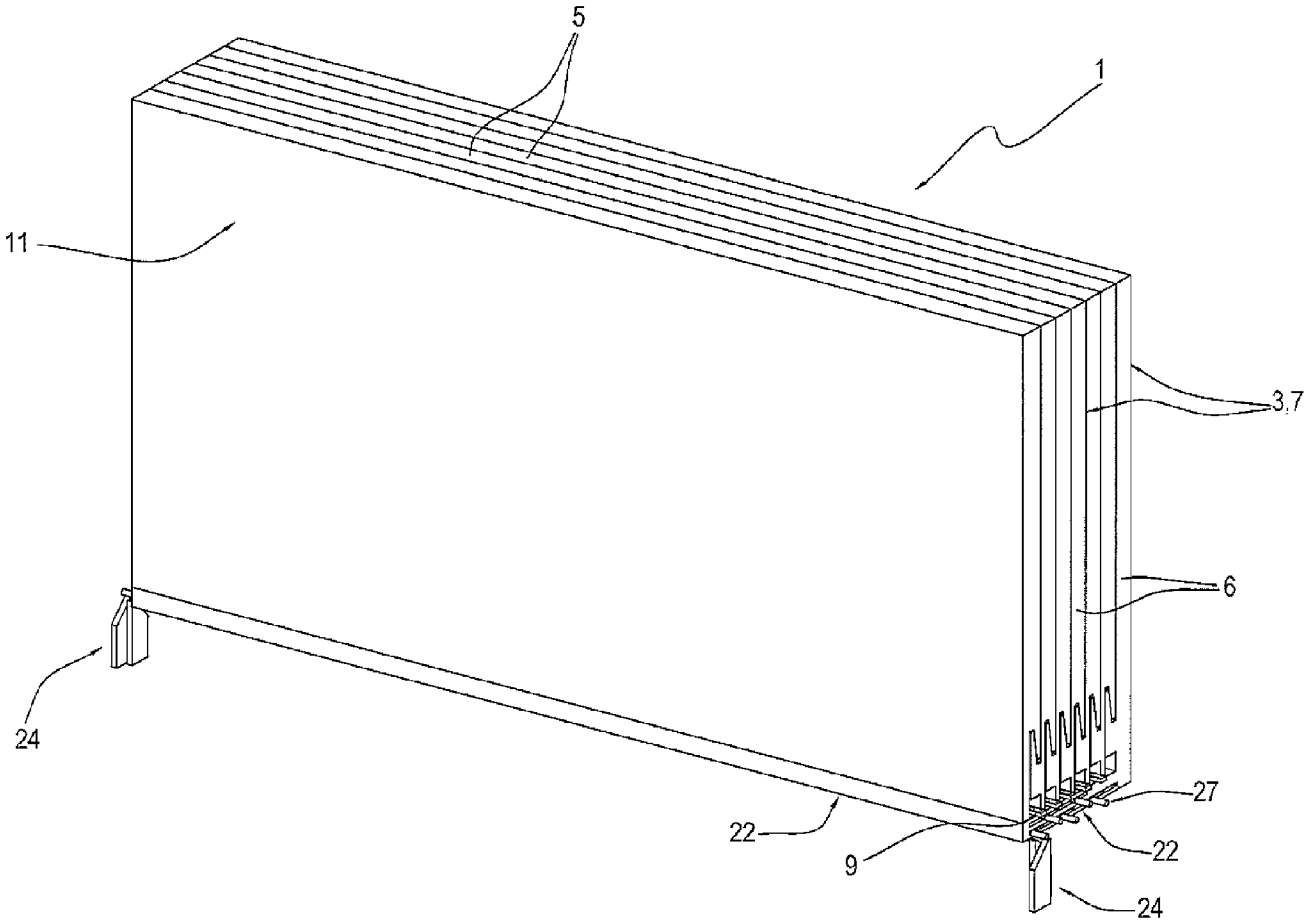
FIG. 1 schematically illustrates a tray for containing products with reduced longitudinal dimensions for the tobacco industry in the configuration where the tray is closed in a pack.
Figure 7:
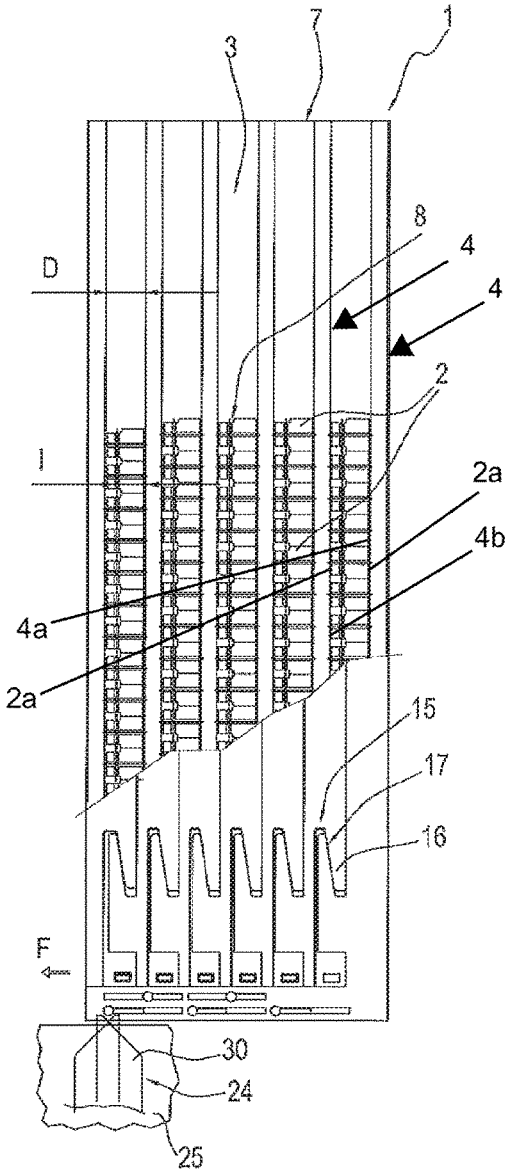
FIG. 7 shows a schematic side view of the tray of FIG. 1 in a first emptying operating position, with one part cut away to better illustrate the products with reduced longitudinal dimensions accumulated in the respective chambers and/or modules.

With reference to FIGS. 1 and 7, the numeral 1 denotes a tray made according to this invention for containing products 2 with reduced longitudinal dimensions.

As mentioned in the introductory section of the description, the products 2 with reduced longitudinal dimensions are referred to as "non-cuttable" products by experts in the trade and, for simplicity, without limiting the scope of the invention, are defined as small cylindrical pieces of filter paper, cellulose acetate or activated carbon used by the manufacturing machines as basic products to make composite filters or cigarettes with composite filters.

As illustrated in FIGS. 2, 7, 3 and 4, the tray 1 comprises a plurality of accumulation chambers 3 where the products 2 are made to accumulate.

Each chamber 3 is perimetrically delimited by a rear wall 4, a base wall 5 and two side walls 6 at the two short end edges of the rear wall 4.

The two side walls 6 are parallel to each other and substantially perpendicular to the rear wall 4 and base wall 5.

Thus, in the embodiment illustrated, each chamber 3 defines with its rear wall and perimeter walls (side walls 6 and base wall 4) a module 7 for containing a layer 8 (FIG. 7) of a plurality of products 2 with reduced longitudinal dimensions.

That means the tray 1 is a multi-layer tray of products 2.

More specifically, each module 7 has a discharge mouth 9 at the free long edge of the rear wall 4.

Obviously, in a further embodiment, not illustrated but nevertheless protected by the claims appended to this description, the tray 1 might consist of a single body and not one of set of modules 7 that can be put together.

In this further embodiment, the plurality of side walls 6 and base walls 5 making up the tray 1 are substituted for respective single walls defining the side walls of the tray 1 itself which nevertheless has within it a plurality of walls, likened to rear walls, in such a way as to define the single accumulation chambers and a plurality of discharge mouths, one for each accumulation chamber.

It should also be borne in mind that although each module 7 is represented in the accompanying drawings with its base wall 5 at the top, this should not mislead the reader, since the modules 7 and the tray 1 are always represented in the emptying position, that is, with the discharge mouths 9 of the individual chambers 3 at the bottom. In effect, it should be remembered that the individual chambers 3, when the products are filled into them, are rotated by at least 90 degrees and by up to as much 180 degrees compared to the position shown in the accompanying drawings. That way, filling is easier and losses due to products 2 falling out through the discharge mouth 9 are prevented.

Thus, each chamber 3 is designed to contain a layer 8 of a plurality of products 2 with reduced longitudinal dimensions, stored according to an ordered orientation and covering the entire surface of the rear wall 4.

As illustrated in FIG. 7, once the tray 1 has been made up and the modules 7 are all back-to-back and closed in a pack, the respective rear walls 4 of the accumulation chambers 3 are parallel to each other and the distance "D" between the inside face 4*a* of the rear wall 4 of a generic first chamber 3 (chosen from the many making up the tray 1) and the outside face 4*b* of the rear wall 4 of a second chamber 3 adjacent to the first and positioned to close the first chamber 3, is substantially equal to the reduced longitudinal dimensions "I" of each product 2.

All the products 2 are therefore positioned with their longitudinal ends 2*a* substantially in contact with the outside face 4*b* and the inside face 4*a* of two consecutive and adjacent modules.

It is evident that the term "substantially" to describe contact of the longitudinal ends 2*a* of each product 2 with the faces 4*a* and 4*b* of the rear walls of each chamber 3 indicates that there is in fact a small gap between the two ends 2*a* of each product 2 and the faces 4*a* and 4*b* so that when the chamber 3 is being emptied, the products 2 can slide easily towards the discharge mouth 9 but are unable to change their orientation relative thereto.

In order to allow each tray 1 to contain more than one layer and to be quickly assembled and disassembled by stacking together the plurality of modules 7 which define the thickness of the tray 1 itself, connecting and disconnecting means 10 are provided between one module 7 and another in such a way that each tray 1 can be made up by assembling a number of modules 7 which varies according to the requirements of the machines they have to feed.

More specifically, the tray 1 comprises a front wall 11 whose surface dimensions are equal to those of the rear wall 4 of each chamber 3 and/or module 7. The front wall 11 is connectable to the open part of the last chamber 3 and/or module 7 in order to close the tray 1 for which it acts like a lid.

Figure 6:
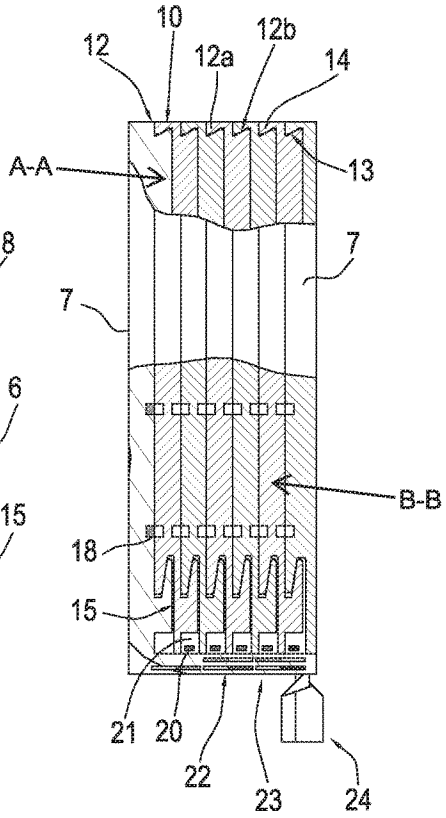
FIGS. 5 and 6 schematically show a front view of the tray of FIG. 1 with the front wall cut away and, respectively, two cross sections A-A and B-B of the tray of FIG. 5.
Figure 5:
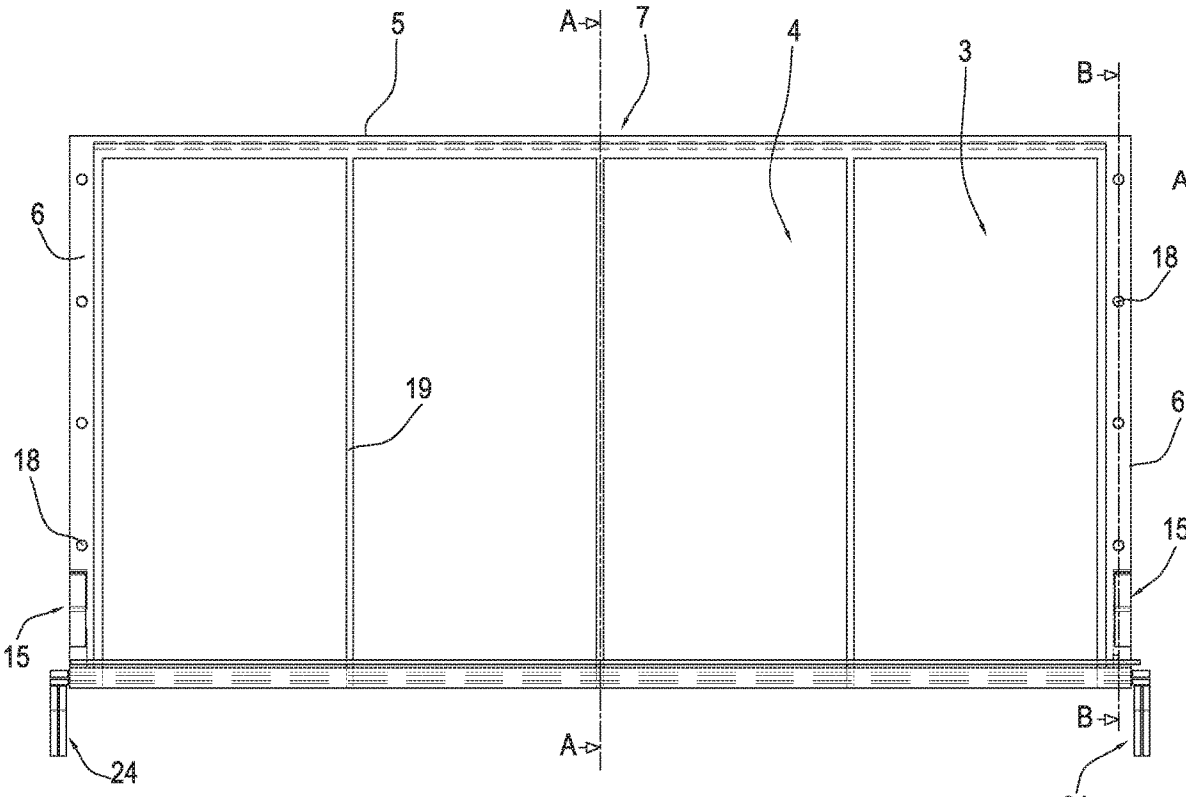

With reference to each module 7, and with reference to FIGS. 3, 4 and 6, the connecting and disconnecting means 10 comprise a first joint 12, with a profiled tongue 12*a* and a groove 12*b*, defined between the inside edge 13 of the base wall 5 of a module 7 and the outside edge 14 of an adjacent module 7.

The profiled tongue 12*a*, which defines the tenon, has a sawtoothed transversal cross section and is designed to fit into the groove 12*b*, which defines the mortise.

The cross section of the groove 12*b* is shaped to form a space which matches the sawtoothed shape of the profiled tongue 12*a*.

In other words, the tongue and groove joint 12 defines the tenon for connection and disconnection and has a sawtooth shaped transversal cross section. It is designed to fit into the grooved outer edge 14 of the adjacent module 7 which defines the mortise and whose transversal cross section is shaped to form a space which matches the sawtoothed shape.

The connecting and disconnecting means 10 also comprise a pair of second joints 15 at the free ends of the two side walls 6.

Figure 8:
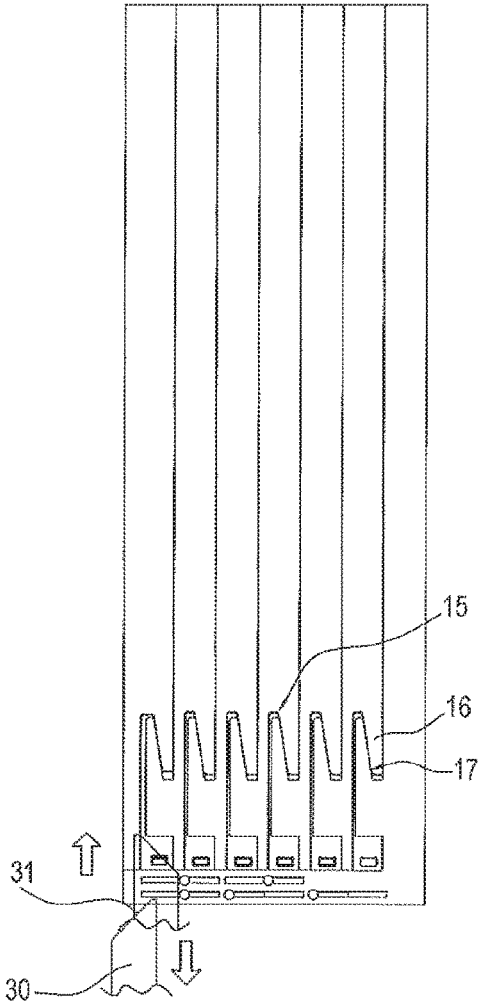
FIGS. 8 to 10 show schematic side views of the tray of FIG. 1 in further operating positions for emptying the products with reduced longitudinal dimensions.
Figure 9:
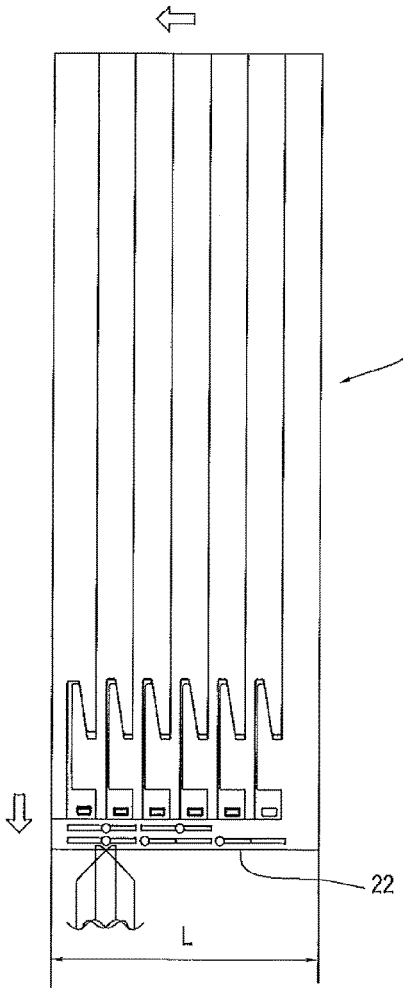
Figure 10:
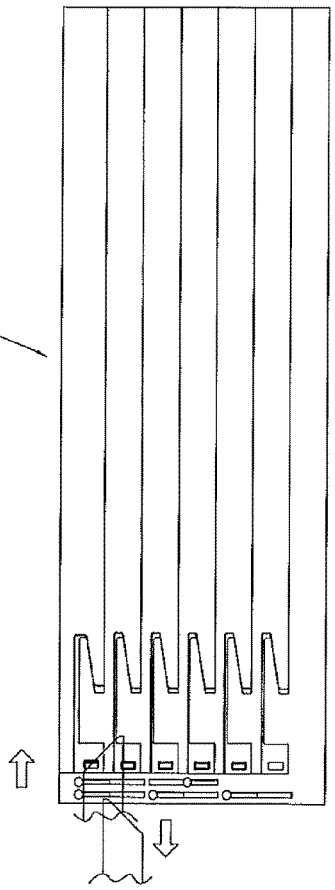

Each second joint 15 comprises a V-shaped tooth 16 defining the tenon and is designed to fit into a recess 17 defining the mortise. See FIGS. 2*a*, 7 and 8.

The recess 17 forms a space whose shape matches that of the V-shaped tooth and towards the bottom has the size of the tooth 16 calculated in such a way that when the two inclined planes slide relative to each other they produce a tightening force between the adjacent modules 7.

Lastly, the connecting and disconnecting means 10 also comprise at least one or more permanent magnets 18 fitted inside the side walls 6 of each module 7.

When two adjacent modules 7 are connected, the first and second joints 12, 15 slide relative to each other until reaching a secure position of mutual connection. During the sliding of the two modules 7 relative to each other in a plane substantially parallel to the rear walls 4 the magnets reach a position of mutual contact, face to face, in such a way as to produce a force of attraction which allows good contact between the adjacent modules 7.

As illustrated in FIGS. 2, 3, 4 and 5, the rear walls 4 have one or more stiffening ribs 19 which are substantially parallel to the two side walls 6.

As described in detail above, each chamber 3 and/or module 7 has, on the side opposite the base wall 5, a mouth 9 for discharging the products 2.

Figure 2:
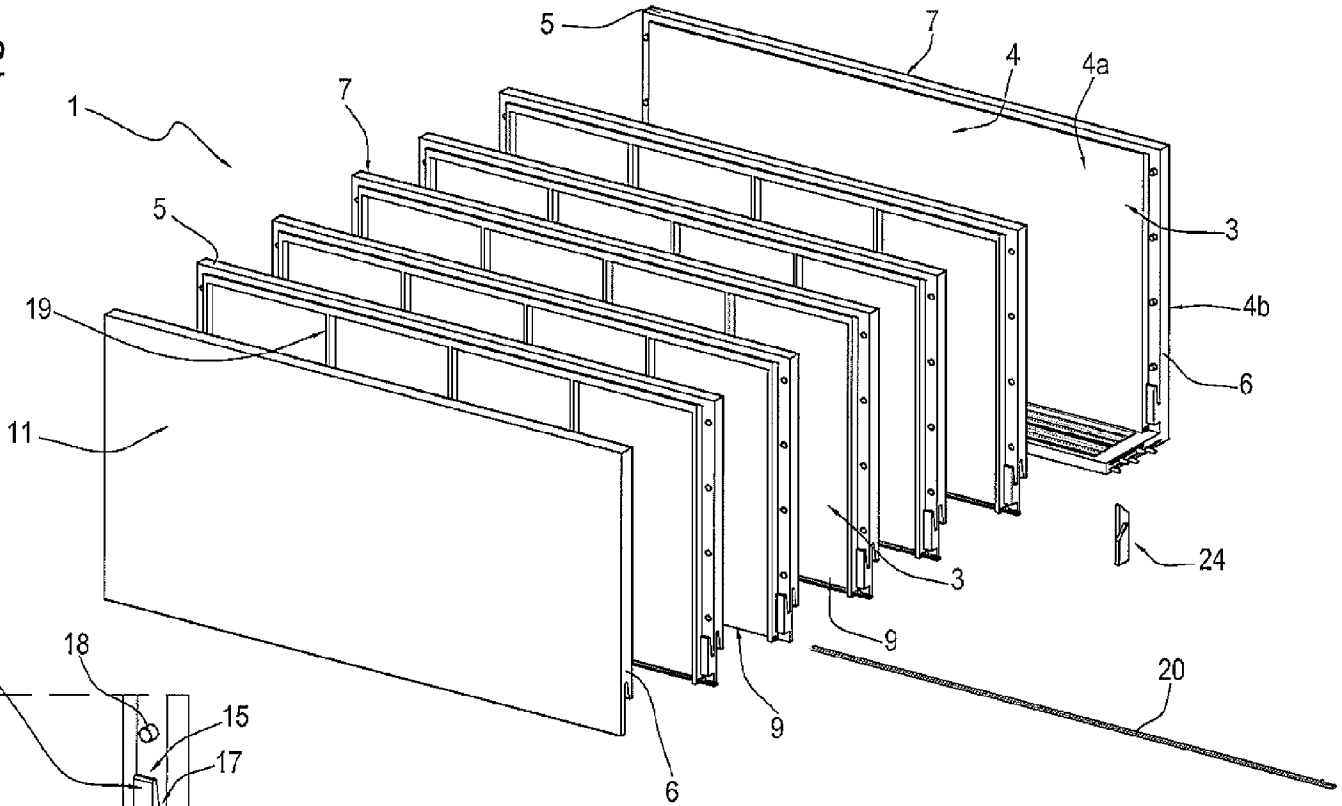
FIG. 2 shows the tray of FIG. 1 in a schematic exploded view.
Figure 2A:
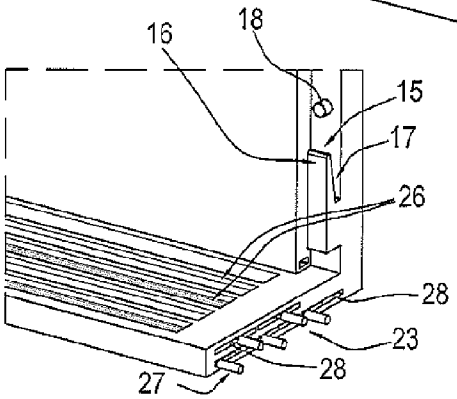
FIG. 2*a* is a schematic perspective view of a scaled-up detail of the tray of FIG. 2.

More specifically, with reference to FIGS. 2, 2*a* and 6, at each discharge mouth 9 there is a rod 20 which is slidable into holes 21 made at the free ends of the two side walls 6 and which is releasably fixable in such a way as to retain the products 2 when the tray 1 is being moved from the position where it accumulates the products 2 to its emptying or discharge position.

It should be noted that the holes 21 for the passage of the rods 20 may also be made at the free bottom ends of each rib 19.

At the discharge mouths 9 for emptying the chambers 3 and/or modules 7, the tray 1 has a bottom closing wall 22. It should be noted that in the embodiment illustrated, the bottom closing wall 22 is made as one with one of the modules 7. More specifically, as illustrated in FIG. 2, the closing wall 22 forms part of the first module 7, the one on the right, looking at FIG. 2, and extends substantially parallel to the base wall 5 and opposite thereto.

In other words, the bottom closing wall 22 forms part of the first of a series of chambers 3 and/or modules 7 onto which all the chambers 3 and/or modules 7 are compacted one after the other, fixed to each other by the connecting and disconnecting means 10.

A length of the bottom closing wall 22 is such as to close all the discharge mouths 9 of all the chambers 3 and/or modules 7 which, once connected to each other, make up the tray 1 when closed in a pack.

As illustrated in FIGS. 2*a*, 7, 8, 9 and 10, the bottom closing wall 22 comprises opening and closing means 23 for each of the discharge mouths 9 of each chamber and/or module.

Each opening and closing means 23 can be moved independently of the other by the movement means 24 which operate at an emptying station where the products 2 are discharged into a manufacturing machine of the tobacco industry.

It should be noted that the emptying station is schematically represented as a block 25 under the tray 1 illustrated in FIG. 7.

The opening and closing means 23 comprise one guillotine gate valve 26 for each of the discharge mouths 9 of each chamber 3.

Each gate valve 26 comprises, at each of its two ends, a pin 27 which protrudes from the respective flank of the bottom closing wall 22 at respective slots 28.

In an embodiment not illustrated, each pin 27 may have a cam follower roller keyed to it.

It should be noted that the cam which acts in conjunction with the pin 27 or the roller, if any, is defined by an inclined profile 31 of at least one pair of flat rods 30. More specifically, there are two pairs of flat rods.

Each pair of flat rods 30 extends along a direction parallel to the side walls 6 of the tray 1 and is movable between two positions, a position where the gate valves 26 are open and a position where they are closed.

In use, during operation, the tray 1 is made to advance step by step in the direction indicated by the arrow F in FIG. 7 in such a way that, at each step, the discharge mouth 9 of one chamber 3 is moved to the correct emptying position above the emptying station 25.

The flat rods 30 move upwardly in such a way that their inclined profiles 31 come into contact with the corresponding pin 27 or cam follower roller, if any, of the gate valve 26 that has to be opened. Once the pin 27 or roller, if any, has moved along the respective slot 28, the lateral edge of the flat rod 30 allows the gate valve 26 to remain in the open position. The cycle is repeated for each gate valve 26. It should be noted that for two consecutive and adjacent modules, the gate valves are located in two superposed planes so that opening one of the two mouths corresponds to closing the other.

The opening and closing cycle of the gate valves 26 may also be easily inferred from FIGS. 7 to 10, which illustrate the different steps of operation.

The invention claimed is:

1. A tray for containing a plurality of products for the tobacco industry, the plurality of products having a shape of at least one chosen from a rod, a tube and a cylinder, the tray comprising:

a plurality of accumulation chambers, each of which is delimited at least by a rear wall and a base wall connected to each other and perpendicular to each other, wherein the rear wall of each accumulation chamber has an inside face facing the plurality of products to be contained in the corresponding of accumulation chamber and an outside face opposite the inside face, wherein each of the plurality of accumulation chambers is shaped to contain a layer of the plurality of products stored according to an ordered orientation and covering the inside face;

wherein the rear walls of the plurality of accumulation chambers are parallel to each other and a distance between the inside face of the rear wall of a selected one of the plurality of accumulation chambers and the outside face of the rear wall of a next one of the plurality of accumulation chambers adjacent to the selected one of the plurality of accumulation chambers on a side facing the inside face of the selected one of the plurality of accumulation chambers is substantially the same as a dimension of the plurality of products to be contained in the selected one of the plurality of accumulation chambers, wherein the inside face of the rear wall of the selected one of the plurality of accumulation chambers and the outside face of the rear wall of the next one of the plurality of accumulation chambers adjacent to the selected one of the plurality of accumulation chambers face towards a same accumulation chamber;

wherein each of the plurality of accumulation chambers defines with its walls a stackable module for containing a layer of the plurality of products such that the plurality of accumulation chambers define a plurality of stackable modules which can be assembled with each other to define a thickness of the tray;

a connecting and disconnecting means between each of the plurality of stackable modules and an adjacent one of the plurality of stackable modules so that the tray may be composed of a variable number of the plurality of stackable modules.

2. The tray according to claim 1, wherein each of the plurality of accumulation chambers and each of the plurality of stackable modules also comprises two side walls at ends of the rear wall, the two side walls being parallel to each other and substantially perpendicular to the rear wall and to the base wall, the accumulation chambers and the stackable modules being arranged in succession one after another along a stacking direction which is perpendicular to the rear walls.

3. The tray according to claim 1, further comprising a front wall having surface dimensions equal to those of the rear wall of each of the plurality of accumulation chambers and each of the plurality of stackable modules, the front wall being connectable to an open part of a foremost accumulation chamber of the plurality of accumulation chambers and/or a foremost stackable module of the plurality of stackable modules in order to close the tray.

4. The tray according to claim 2, wherein each base wall has an inside edge and an outside edge, parallel to each other and parallel to the rear walls, and wherein the connecting and disconnecting means includes a first joint, with a profiled tongue and a groove, defined between the inside edge of the base wall of each of the plurality of stackable modules and the outside edge of the base wall of the adjacent one of the plurality of stackable modules; the profiled tongue, defining a tenon, having a sawtoothed cross section and being shaped to fit into the groove, the groove defining a mortise, a cross section of the groove being shaped to form a space which matches the sawtoothed cross section of the profiled tongue.

5. The tray according to claim 4, wherein the connecting and disconnecting means includes a pair of second joints at ends of the two side walls opposite the base wall; each second joint comprising a V-shaped tooth defining a second tenon and shaped to fit into a recess defining a second mortise and forming a second space having a shape matching that of the V-shaped tooth.

6. The tray according to claim 2, wherein the connecting and disconnecting means includes a first permanent magnet fitted inside one of the two side walls of each of the plurality of stackable modules and a second permanent magnet fitted into a corresponding side wall of the adjacent one of the plurality of stackable modules such that the first permanent magnet and the second permanent magnet attract to one another to pull together each of the plurality of stackable modules and the adjacent one of the plurality of stackable modules.

7. The tray according to claim 2, further comprising one or more stiffening ribs positioned on at least one of the rear walls, the one or more stiffening ribs being substantially parallel to the two side walls.

8. The tray according to claim 2, wherein each of the plurality of accumulation chambers and each of the plurality of stackable modules has, on a side opposite the base wall a discharge mouth for discharging the plurality of products; there being provided, at the discharge mouth, at least one rod which is slidable into holes made at ends of the two side walls and which is releasably fixable in such a way as to retain the plurality of products when the tray is being handled.

9. The tray according to claim 2, wherein each of the plurality of accumulation chambers and each of the plurality of stackable modules includes, on a side opposite the base wall, a discharge mouth for discharging the plurality of products, wherein the tray comprises a bottom closing wall located at the discharge mouths and having a plurality of slots, wherein the tray further comprises for each of the discharge mouths a guillotine gate valve having two opposite ends, the guillotine gate valve comprising at each of the two opposite ends a pin which protrudes from a flank of the bottom closing wall at a respective one of the plurality of slots; the pin including a cam follower roller, and a cam being defined by an inclined profile of at least one pair of flat rods, each pair of flat rods extending along a direction parallel to one of the two side walls and being movable between a first position where the guillotine gate valve is open and a second position where the guillotine gate valve is closed.

10. The tray according to claim 2, wherein each of the plurality of accumulation chambers and each of the plurality of stackable modules includes, on a side opposite the base wall, a discharge mouth for discharging the plurality of products; wherein the tray further comprises at the discharge mouth, a bottom closing wall made as a single part with one selected from the plurality of accumulation chambers and extending substantially parallel to the base wall; the bottom closing wall having a length which is such as to close all of the discharge mouths of all of the plurality of accumulation chambers and each of the plurality of stackable modules when connected to each other by the connecting and disconnecting means.

11. A tray for containing a plurality of products for the tobacco industry, the plurality of products having a shape of at least one chosen from a rod, a tube and a cylinder, the tray comprising:

a plurality of accumulation chambers, each of which is delimited at least by a rear wall and a base wall connected to each other and perpendicular to each other, wherein the rear wall of each accumulation chamber has an inside face facing the plurality of products to be contained in the corresponding of accumulation chamber and an outside face opposite the inside face, wherein each of the plurality of accumulation chambers is shaped to contain a layer of the plurality of products stored according to an ordered orientation and covering the inside face;

wherein the rear walls of the plurality of accumulation chambers are parallel to each other and a distance between the inside face of the rear wall of a selected one of the plurality of accumulation chambers and the outside face of the rear wall of a next one of the plurality of accumulation chambers adjacent to the selected one of the plurality of accumulation chambers on a side facing the inside face of the selected one of the plurality of accumulation chambers is substantially the same as a dimension of the plurality of products to be contained in the selected one of the plurality of accumulation chambers, wherein the inside face of the rear wall of the selected one of the plurality of accumulation chambers and the outside face of the rear wall of the next one of the plurality of accumulation chambers adjacent to the selected one of the plurality of accumulation chambers face towards a same accumulation chamber;

wherein each of the plurality of accumulation chambers defines with its walls a stackable module for containing a layer of the plurality of products such that the plurality of accumulation chambers define a plurality of stackable modules which can be assembled with each other to define a thickness of the tray;

a connecting and disconnecting device between each of the plurality of stackable modules and an adjacent one of the plurality of stackable modules so that the tray may be composed of a variable number of the plurality of stackable modules, the connecting and disconnecting device including first and second engaging surfaces on adjacent ones of the plurality of stackable modules, the first and second engaging surfaces shaped to interlock with one another to connect the adjacent ones of the plurality of stackable modules.

12. The tray according to claim 9, wherein each of the plurality of accumulation chambers and each of the plurality of stackable modules also comprises two side walls at ends of the rear wall, the two side walls being parallel to each other and substantially perpendicular to the rear wall and to the base wall, the accumulation chambers and the stackable modules being arranged in succession one after another along a stacking direction which is perpendicular to the rear walls.

13. The tray according to claim 11, further comprising a front wall having surface dimensions equal to those of the rear wall of each of the plurality of accumulation chambers and each of the plurality of stackable modules, the front wall being connectable to an open part of a foremost accumulation chamber of the plurality of accumulation chambers and/or a foremost stackable module of the plurality of stackable modules in order to close the tray.

14. The tray according to claim 12, wherein each base wall has an inside edge and an outside edge, parallel to each other and parallel to the rear walls, and wherein the connecting and disconnecting device includes a first joint, with a profiled tongue and a groove, defined between the inside edge of the base wall of each of the plurality of stackable modules and the outside edge of the base wall of the adjacent one of the plurality of stackable modules; the profiled tongue, defining a tenon, having a sawtoothed cross section and being shaped to fit into the groove, the groove defining a mortise, a cross section of the groove being shaped to form a space which matches the sawtoothed cross section of the profiled tongue.

15. The tray according to claim 12, wherein the connecting and disconnecting device includes a pair of second joints at ends of the two side walls opposite the base wall; each second joint comprising a V-shaped tooth defining a second tenon and shaped to fit into a recess defining a second mortise and forming a second space having a shape matching that of the V-shaped tooth.

16. The tray according to claim 12, wherein the connecting and disconnecting device includes a first permanent magnet fitted inside one of the two side walls of each of the plurality of stackable modules and a second permanent magnet fitted into a corresponding side wall of the adjacent one of the plurality of stackable modules such that the first permanent magnet and the second permanent magnet attract to one another to pull together each of the plurality of stackable modules and the adjacent one of the plurality of stackable modules.

17. The tray according to claim 12, further comprising one or more stiffening ribs positioned on at least one of the rear walls, the one or more stiffening ribs being substantially parallel to the two side walls.

18. The tray according to claim 12, wherein each of the plurality of accumulation chambers and each of the plurality of stackable modules has, on a side opposite the base wall a discharge mouth for discharging the plurality of products; there being provided, at the discharge mouth, at least one rod which is slidable into holes made at ends of the two side walls and which is releasably fixable in such a way as to retain the plurality of products when the tray is being handled.

19. The tray according to claim 12, wherein each of the plurality of accumulation chambers and each of the plurality of stackable modules includes, on a side opposite the base wall, a discharge mouth for discharging the plurality of products, wherein the tray comprises a bottom closing wall located at the discharge mouths and having a plurality of slots, wherein the tray further comprises for each of the discharge mouths a guillotine gate valve having two opposite ends, the guillotine gate valve comprising at each of the two opposite ends a pin which protrudes from a flank of the bottom closing wall at a respective one of the plurality of slots; the pin including a cam follower roller, and a cam being defined by an inclined profile of at least one pair of flat rods, each pair of flat rods extending along a direction parallel to one of the two side walls and being movable between a first position where the guillotine gate valve is open and a second position where the guillotine gate valve is closed.

20. The tray according to claim 12, wherein each of the plurality of accumulation chambers and each of the plurality of stackable modules includes, on a side opposite the base wall, a discharge mouth for discharging the plurality of products; wherein the tray further comprises at the discharge mouth, a bottom closing wall made as a single part with one selected from the plurality of accumulation chambers and extending substantially parallel to the base wall; the bottom closing wall having a length which is such as to close all of the discharge mouths of all of the plurality of accumulation chambers and each of the plurality of stackable modules when connected to each other by the corresponding connecting and disconnecting devices.

* * * * *